US008986176B2

(12) United States Patent
Arst

(10) Patent No.: US 8,986,176 B2
(45) Date of Patent: Mar. 24, 2015

(54) ISOPED EXERCISE DEVICE

(76) Inventor: Lani Renae Arst, Fredericksburg, TX (US)

( * ) Notice: Subject to any disclaimer, the term of this patent is extended or adjusted under 35 U.S.C. 154(b) by 574 days.

(21) Appl. No.: 13/406,498

(22) Filed: Feb. 27, 2012

(65) Prior Publication Data

US 2012/0157268 A1 Jun. 21, 2012

Related U.S. Application Data

(63) Continuation-in-part of application No. 12/798,781, filed on Apr. 12, 2010, now abandoned.

(60) Provisional application No. 61/300,907, filed on Feb. 3, 2010.

(51) Int. Cl.

| | |
|---|---|
| ***A63B 21/015*** | (2006.01) |
| ***A63B 22/02*** | (2006.01) |
| ***A63B 23/08*** | (2006.01) |
| ***A63B 23/10*** | (2006.01) |
| *A63B 22/00* | (2006.01) |

(52) U.S. Cl.

CPC ..... *A63B 22/02* (2013.01); *A63B 2208/0233* (2013.01); *A63B 21/015* (2013.01); *A63B 2022/0292* (2013.01); *A63B 2022/0038* (2013.01)

USPC ..... 482/119; 482/54; 482/79

(58) Field of Classification Search

CPC .... A63B 21/012; A63B 21/015; A63B 22/02; A63B 23/035; A63B 23/04; A63B 2022/02; A63B 2022/0292; A63B 2023/035; A63B 2023/04

USPC ..... 482/23, 37, 51, 54–56, 69–71, 74, 79, 482/80, 91, 92, 114, 115, 118–121, 482/127–139, 142, 145, 146, 904; 119/700; D21/662, 668, 669, 685

See application file for complete search history.

(56) References Cited

U.S. PATENT DOCUMENTS

| | | | | |
|---|---|---|---|---|
| 3,941,377 | A | 3/1976 | Lie | |
| 4,151,988 | A * | 5/1979 | Nabinger | 482/54 |
| 4,204,673 | A * | 5/1980 | Speer, Sr. | 482/5 |
| 5,302,162 | A | 4/1994 | Pasero | |
| 5,372,560 | A * | 12/1994 | Chang | 482/54 |
| 5,538,489 | A * | 7/1996 | Magid | 482/54 |
| 5,607,376 | A * | 3/1997 | Magid | 482/54 |
| 5,679,101 | A * | 10/1997 | Magid | 482/54 |
| 6,331,153 | B1 * | 12/2001 | McClellan | 482/52 |
| 6,893,382 | B1 | 5/2005 | Moon et al. | |
| 7,226,396 | B2 | 6/2007 | Buechel et al. | |
| 2004/0132586 | A1 | 7/2004 | Leighton et al. | |
| 2004/0192516 | A1 | 9/2004 | Buechel, Jr. et al. | |

* cited by examiner

*Primary Examiner* — Oren Ginsberg

(74) *Attorney, Agent, or Firm* — Jackson Walker L.L.P.; Christopher J. Rourk

(57) ABSTRACT

Disclosed herein is an exercise device comprising a plurality of belt members attached to, and arranged in parallel on a base frame, the exercise device further comprising at least one frictional member disposed in frictional contact with, and forcibly biased against a surface of at least roller in communication with the belt such that an external force applied to at least one of the belts is opposed by a frictional force provided by the frictional contact between the frictional member and the roller. A method of exercising using the exercise device is also disclosed.

18 Claims, 4 Drawing Sheets

ISOPED EXERCISE DEVICE

CROSS REFERENCE TO RELATED APPLICATIONS

This application claims priority to and the benefit of U.S. patent application Ser. No. 12/798,781, filed Apr. 12, 2010, which is hereby incorporated herein by reference in its entirety.

BACKGROUND

The statements in this section merely provide background information related to the present disclosure and may not constitute prior art.

Exercise is consistent with physical and mental health. Exercise of the lower extremities including the gluteous maximus, thighs, calves, hamstrings, and the like may be difficult for one with limited mobility, who is chair bound, or with a demanding schedule. A lack of exercise may result in not achieving proper circulation to lower extremities and/or other parts of the body.

SUMMARY

Some embodiments are directed to an exercise device. Other embodiments include unique systems and methods for utilizing the exercise device disclosed herein. Further embodiments, forms, objects, features, advantages, aspects, and benefits shall become apparent from the below description and drawings.

In an embodiment, an exercise device comprises a base frame comprising a plurality of belt members attached to, and arranged in parallel on the base frame, wherein each of the belt members comprises: a front axle attached to the base frame oriented along a front central axis separated by a distance from a rear axle attached to the base frame having a rear central axis, wherein the front central axis is essentially parallel to the rear central axis; a front roller disposed around the front axle and arranged to rotate around the front central axis; a rear roller disposed around the rear axle and arranged to rotate around the rear central axis; an endless belt having an infinite number of sides disposed around and in contact with a portion of the front roller and a portion of the rear roller, the endless belt having a major axis oriented perpendicular to the front central axis and a minor axis oriented parallel to the front central axis; the exercise device further comprising at least one frictional member disposed in frictional contact with, and forcibly biased against a surface of at least one front roller, rear roller, or a combination thereof such that an external force directed perpendicular to the front central axis applied to at least one of the endless belts is opposed by a frictional force provided by the frictional contact between the frictional member and the at least one surface of the front roller, the rear roller, or a combination thereof.

In an embodiment, a method to exercise comprises applying an external force to an endless belt of an exercise device in an amount sufficient to overcome a frictional force provided by the exercise device opposed to the applied force, wherein the exercise device comprises a base frame comprising a plurality of belt members attached to, and arranged in parallel on the base frame, wherein each of the belt members comprises: a front axle attached to the base frame oriented along a front central axis separated by a distance from a rear axle attached to the base frame having a rear central axis, wherein the front central axis is essentially parallel to the rear central axis; a front roller disposed around the front axle and arranged to rotate around the front central axis; a rear roller disposed around the rear axle and arranged to rotate around the rear central axis; the endless belt having an infinite number of sides disposed around and in contact with a portion of the front roller and a portion of the rear roller, the endless belt having a major axis oriented perpendicular to the front central axis and a minor axis oriented parallel to the front central axis; the exercise device further comprising at least one frictional member disposed in frictional contact with, and forcibly biased against a surface of at least one front roller, rear roller, or a combination thereof such that the external force directed perpendicular to the front central axis applied to at least one of the endless belts is opposed by the frictional force provided by the frictional contact between the frictional member and the at least one surface of the front roller, the rear roller, or a combination thereof.

DETAILED DESCRIPTION

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a physical range listed or described as being useful, suitable, or the like, is intended that any and every value within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

As used in the specification and claims, "near" is inclusive of "at."

As used in the specification and claims, "forcibly biased" includes one material or surface being forced against another material or surface.

As used herein, a "major axis" of an item is longer than a "minor axis" of the same item.

As used herein, a "belt tension" includes a pulling force exerted by the belt when the belt is stretched between two points separated by a distance.

Figure 3A:
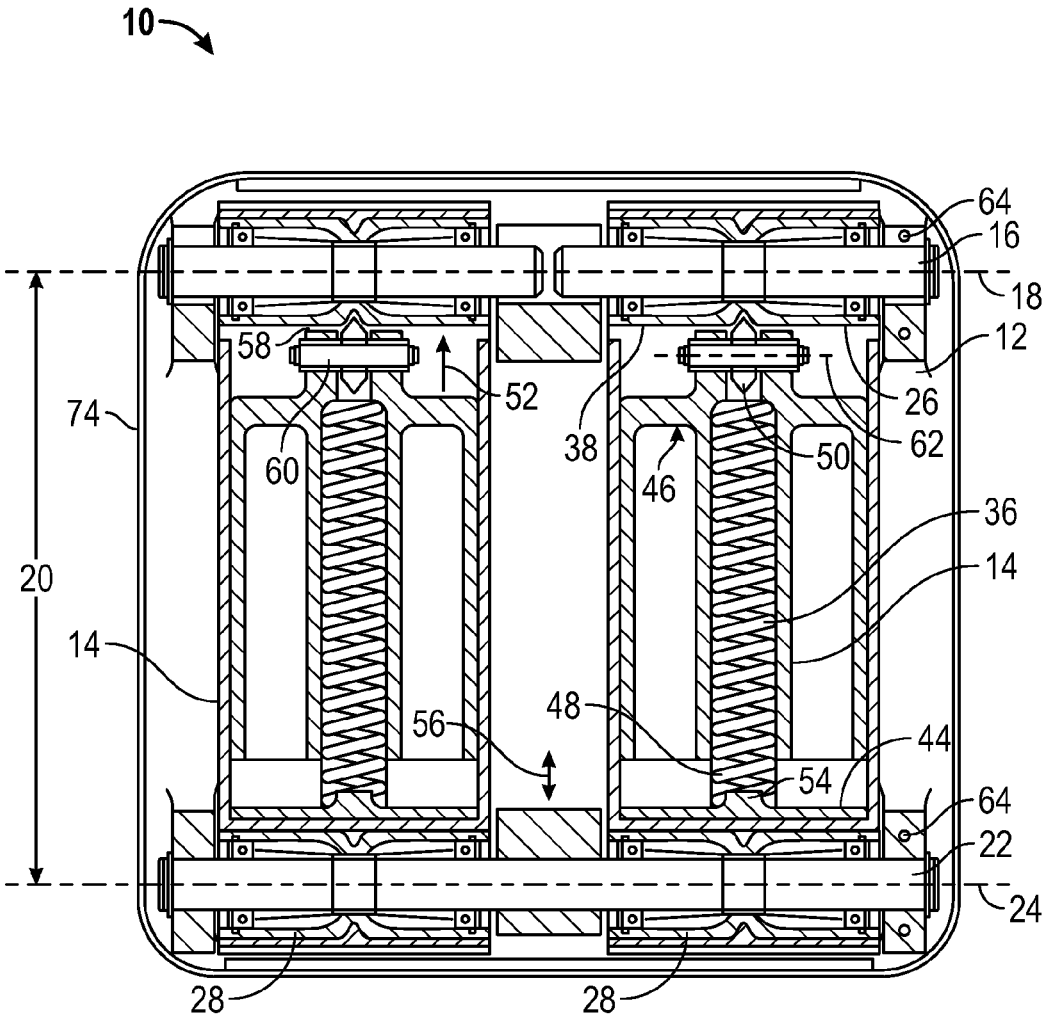
FIG. 3A is a schematic top view of an exercise device according to an embodiment, of the instant disclosure.

As shown in FIG. 3A, in an embodiment, an exercise device 10 comprises a base frame 12 comprising a plurality of belt members, represented generally as 14 attached to, and arranged in parallel on base frame 12. In an embodiment, each of belt members 14 comprises a front axle 16 attached to base frame 12 oriented along a front central axis 18 and separated by a distance 20 from a rear axle 22 attached to base frame 12 having a rear central axis 24. In an embodiment, front central axis 18 is essentially parallel to rear central axis 24.

Figure 2A:
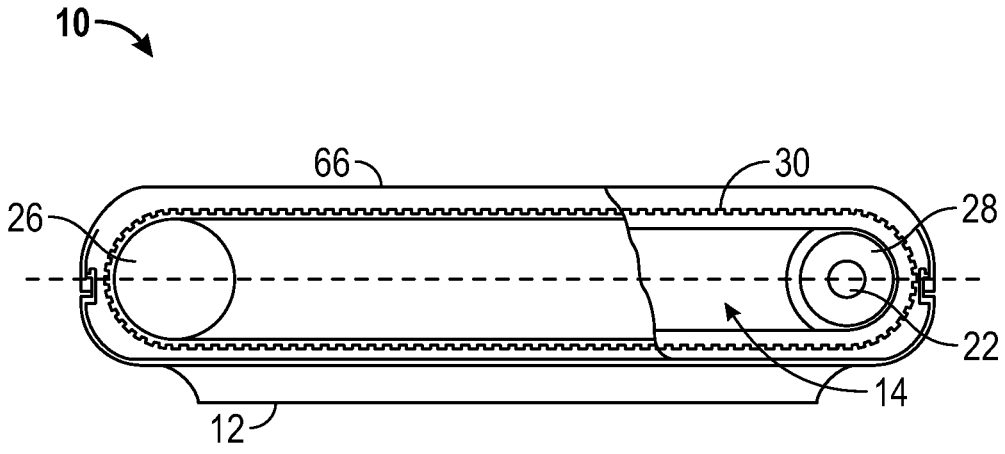
FIG. 2A is a cut-away side view along axis A-A of FIG. 1 of an exercise device according to an embodiment, of the instant disclosure.
Figure 2B:
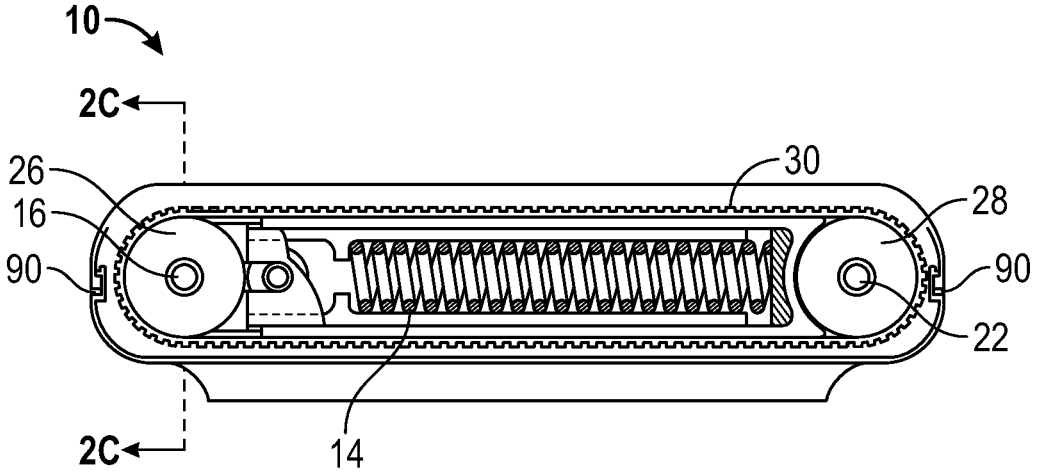
FIG. 2B is a cut-away side view along axis B-B of FIG. 1 of an exercise device according to an embodiment, of the instant disclosure.
Figure 3B:
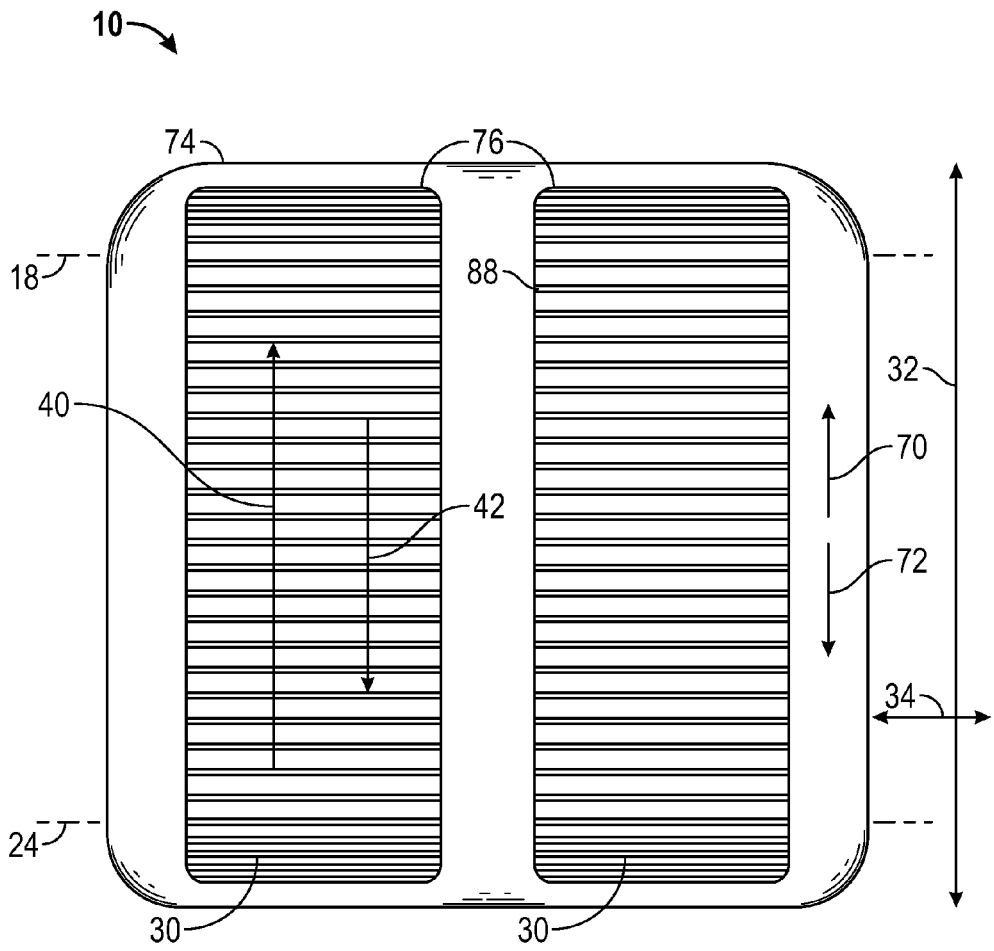
FIG. 3B is a top view of an exercise device according to an embodiment, of the instant disclosure.

In an embodiment, belt member 14 may further comprise a front roller disposed around front axle 16 and arranged to rotate around front central axis 18. Belt member 14 may further comprise a rear roller 28 disposed around rear axle 22 and arranged to rotate around rear central axis 24. As shown in FIGS. 2A and 2B, in an embodiment, belt member 14 may further include an endless belt 30 having an infinite number of sides disposed around and in contact with a portion of front roller 26 and a portion of rear roller 28. As shown in FIG. 3B, in an embodiment, endless belt 30 may have a major axis 32 oriented perpendicular to front central axis 18 and a minor axis 34 oriented parallel to front central axis 18.

In an embodiment, exercise device 10 further comprises at least one frictional member 36 disposed in frictional contact with, and forcibly biased against a surface, generally represented as 38, of at least one front roller 26, rear roller 28, or a combination thereof, such that an external force 40 directed perpendicular to front central axis 18 applied to at least one of the endless belts 30 is opposed by a frictional force 42 provided by frictional contact between frictional member 36 and at least one surface 38 of front roller 26, rear roller 28, or a combination thereof.

In an embodiment, exercise device 10 comprises a frictional member 36 comprising a first end 44 attached to base frame 12, and a second end 46 movably engaged with first end 44, and a resilient member 48 disposed between, and in mechanical contact with first end 44 and second end 46. In an embodiment, second end 46 further comprises a follower 50 arranged in frictional contact with surface 38 of front roller 26 and/or rear roller 28, or a combination thereof (not shown), wherein resilient member 48 is dimensioned and arranged between first end 44 and second end 46 such that follower 50 is forcibly biased against surface 38 (generally represented by force arrow 52) of front roller 26 and/or rear roller, or a combination thereof (not shown), to provide fictional force 42 (see FIG. 3B).

Frictional force 42 may also be described as a drag force, a resistance to rotation of front roller 26 and/or rear roller 28 in response to an externally supplied force 40, and/or the like. In an embodiment, frictional force 42 is diametrically opposed to, and a response to an applied external force 40.

In an embodiment, resilient member 48 may comprise a compressible helical spring, an air compression cylinder and piston arrangement (not shown), and/or the like, so long as resilient member is capable of providing a force 52 to follower 50 such that follower 50 is forcibly biased against any external surface, indicated generally as 38, of front roller 26, rear roller 28, or a combination thereof.

In an embodiment, frictional member 36 may further comprise an adjustment means 54 capable of providing a variable distance 56 between an end of resilient member 48 and first end 44 and/or first end 44 and base frame 12 (not shown), and/or increasing or reducing the compressive force of resilient member 48 such that the amount of bias force 52 exerted between frictional member 36 and surface 38 of at least one of front roller 26, rear roller 28, or a combination thereof is variable between an upper limit and a lower non-zero limit. In an embodiment, bias force 52, and by extension frictional force 42 is greater than zero, such that at least one of the rollers is not free to rotate in the absence of an applied force, but is instead resistant to rotation around its corresponding axis and may only rotate upon application of an external force greater than the bias force applied by the frictional member. Accordingly, in an embodiment, the belt tension, internal or inherent friction of the various bearings, bushings and the like of the rollers, and/or the like are not factored into the representative bias force.

In an embodiment, follower 50 comprises a rotatable member 58 disposed around and in rotational contact with a follower axel 60 attached to second end 46. In an embodiment, follower axle 60 is arranged such that rotatable member 58 has an axis of rotation 62 parallel to front central axis 18.

In an embodiment, front axle 16, rear axle 22, or both are movably attachable 64 to base frame 12. In an embodiment, front axle 16, rear axle 22 are attachable 64 to base frame 12 in an arrangement to provide a belt tension, which is a tensile force represented generally by arrow 66 (see FIG. 2A) between front axle 16 and rear axle 22 through endless belt 30. In an embodiment, belt tension 66, a tensile force, is independent of the frictional force 42 and/or bias force 52 provided by the frictional contact between frictional member 36 and the at least one surface 38 of front roller 26 and/or rear roller 28. Accordingly, in an embodiment, frictional member 36 does not force the front roller to move relative to the rear roller, and/or rear roller to move relative to front roller, but instead provides a frictional force which acts on the rollers to resist rotation of the roller about the axle on which the roller is mounted.

Figure 2C:
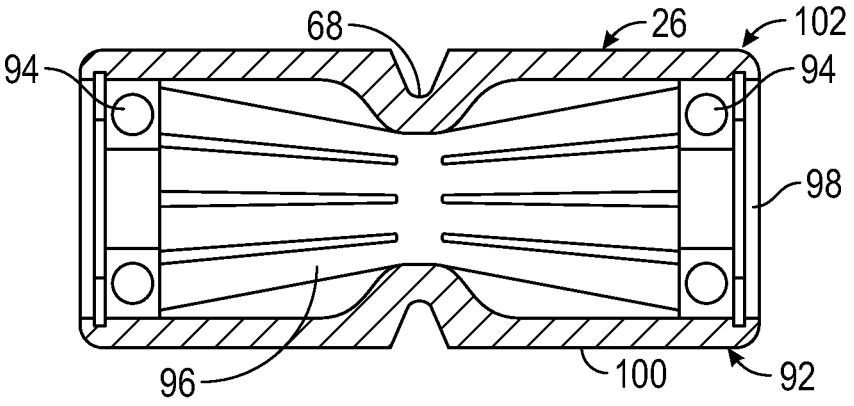
FIG. 2C is a partial cut-away side view along axis C-C of FIG. 2B of an exercise device according to an embodiment, of the instant disclosure.

As shown in FIG. 2C, in an embodiment, front roller 26, rear roller 28, or both comprise a radial groove 68 disposed into the surface of the roller which is dimensioned and arranged to receive a least a portion of frictional member 36, which may include follower 50 (See FIG. 3A).

In an embodiment, frictional member 36 is forcibly biased against surface 38 of front roller 26 and/or rear roller 28 in a direction perpendicular to front central axis 18. In an embodiment, frictional member 36 is forcibly biased against surface 38 of front roller 26 and/or rear roller 28 in a direction parallel to front central axis 18 (not shown).

As shown in FIG. 3B, in an embodiment, exercise device 10 has two belt members 30, wherein front central axis 18 of each of the two belt members and rear central axis 24 of each of the two belt members are collinear.

In an embodiment, at least one frictional member is frictionally engaged with two or more front rollers, two or more rear rollers, or any combination thereof (not shown).

In an embodiment, endless belts 30 of each of the belt members are independently movable in a direction perpendicular to front central axis 18 in a forward direction 70 from rear central axis 24 toward front central axis 18, in a reverse direction 72 from front central axis 18 toward rear central axis 24, or a combination thereof.

In an embodiment, base frame 12 is disposed within an outer covering 74. In an embodiment, outer covering 74 comprising a plurality of openings 76 through which at least a portion of each of endless belts 30 protrudes.

Figure 4:
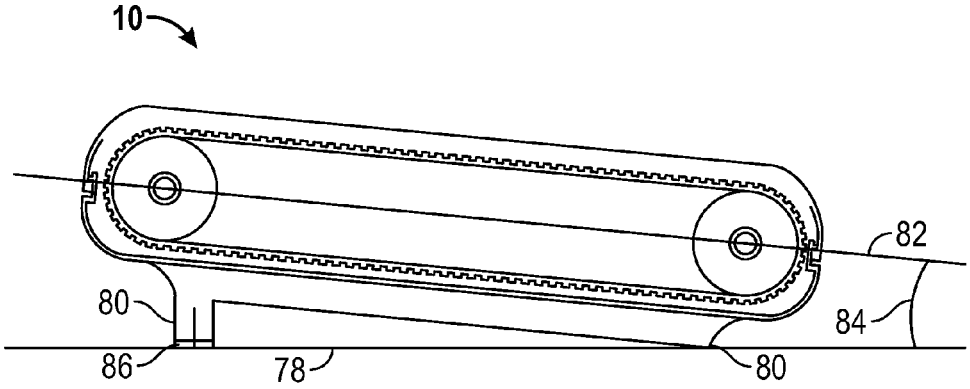
FIG. 4 is a partial cutaway side view of an exercise device according to an embodiment of the instant disclosure disposed on a horizontal surface.

As shown in FIG. 4, in an embodiment, base frame 12 is supported on a horizontal surface 78 by a plurality of supports 80 connected to the base frame, wherein supports 80 are dimensioned and arranged such that a line 82 connecting front central axis 18 and rear central axis 24 is oriented at an angle 84 of less than or equal to about 60°, or less than or equal to about 50°, or less than or equal to about 40°, or less than or equal to about 30°, or less than or equal to about 20°, or less than or equal to about 10° relative to horizontal surface 78.

In an embodiment, at least one of the plurality of supports 80 is independently adjustable 86 such that the angle 84 between line 82 connecting front central axis 18 and rear central axis 24 and horizontal surface 78 is adjustable between about 0° and about 60° relative to horizontal surface 78.

In an embodiment, frictional force 42 opposed to applied external force 40 directed perpendicular to front central axis 18 applied to at least one of the endless belts 30 is from about 1% to less than or equal to about 90%, or less than or equal to about 80%, or less than or equal to about 70%, or less than or equal to about 60%, or less than or equal to about 50%, or less than or equal to about 40%, or less than or equal to about 30%, or less than or equal to about 20%, or less than or equal to about 10% of applied external force 40. In an embodiment, frictional force 42 may be from about 0.44 N (0.1 pound force) to about 44.5 N (10 pound force).

In an embodiment, distance 20 is greater than or equal to about 10 cm and less than or equal to about 50 cm and/or the minor axis 34 of endless belt 30 is from about 5% to about 90% of distance 20.

In an embodiment, endless belt 30 comprises a plurality of ribs 88 disposed on one or more sides of endless belt 30. In an embodiment, the plurality of ribs 88 are oriented perpendicular to or at an acute angle relative to major axis 32 of endless belt 30.

In an embodiment, a method to exercise comprises applying an external force to an endless belt of an embodiment of an exercise device as described herein in an amount sufficient to overcome the frictional force provided by the exercise device opposed to the applied force. In an embodiment, a method to exercise comprises applying an external force to an endless belt of an embodiment of an exercise device as described herein in an amount sufficient to overcome the frictional force provided by the exercise device opposed to the applied force, wherein the external force is applied by a user's foot and/or leg, wherein the user is a person in a sitting position.

In an embodiment, the exercise device according to an embodiment may provide the user with a passive resistance to normal motion of the back of the thigh muscles, the lower legs (calves) and ankles while sitting. Since the motion may be in a periodic or a reciprocating action, similar to walking, little or no motion would be transmitted from the user to the chair or other sitting device. However, this exercise device disclosed herein may be utilized in a standing position depending on the physical limitations of the user.

In an embodiment, internal part count and weight may be minimized and the components designed to minimize the use of friction in all moving parts. In an embodiment, the exercise device may be designed to require zero maintenance for a period of at least three years.

In an embodiment, the base frame assembly may serve as the primary structure wherein all vertical and horizontal loads are reacted by, and transferred through, the base member into the surface on which the device is disposed. The exercise device according to the instant disclosure may be designed to allow easy assembly of all working components during manufacturing as well as during shop servicing. In an embodiment, material selection for the various components including the material to be used in the fabrication of the base frame may include steel, glass fiber reinforced bulk molding compound (bmc), fiberglass, and/or the like. In an embodiment, a recyclable base polymer may be specified. In an embodiment, the base frame material may be chosen such that the base frame is able to withstand a minimum of 15 drops from a height of 36 inches (as part of the finished product) without cracking or damage to any of the internal parts.

In an embodiment, the base frame may be designed to support a maximum static (non-operating) load of at least about 250 pounds evenly distributed over each of the belts. Loads passed through the base frame will be reacted by the floor or a structurally sound platform supplied by the end user. Material thickness and sections may be determined by allowable deflections based on anticipated external, as well as internal, loading according to methods well understood by one of minimal skill in the art. In an embodiment, the outer covering comprises two separate pieces, which may be dimensioned and arranged to snap together using an integral snap device 90 as shown in FIG. 2B. In an embodiment, mechanical fasteners may be used to hold the two or more separate pieces together.

Figure 1:
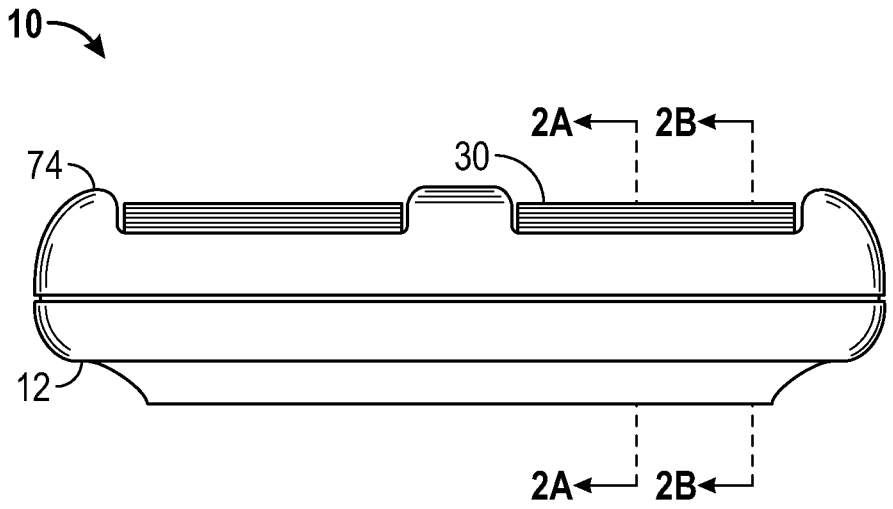
FIG. 1 is a front view of an exercise device according to an embodiment, of the instant disclosure.

The outer cover serves to protect all internal components from liquid spills and damage from falling objects. As depicted in FIG. 1, all features are generously radiused to prevent injury during handling or transport. The parting line between the base member and the outer cover may be held to a profile tolerance sufficient to minimize gaps. The material which may be used in the fabrication of the outer cover may be the same or different as the material used to produce the base frame.

In and embodiment, the outer cover may be dimensioned to withstand overhead drops of a 1 pound steel object at a height of 12 inches one time at any location without cracking through.

The endless belts may further comprise a surface modifier comprising a low friction layer such as perfluoroethylene to minimize wear. In an embodiment, the endless belts may comprise and elastomeric base material, which may include ethylene propylene diene monomer (epdm) rubber, butyl rubber, and/or the like, which may be further reinforced with carbon fiber, metal cords, polyester cords, and/or the like.

Lateral ribs disposed on a surface of the belt may be molded to provide comfortable contact with bare feet and may be dimensioned to facilitate bending around the two rollers without cracking.

As shown in FIG. 2C, in an embodiment, the front and/or rear rollers 26 or 28 may comprise a roller assembly 102 comprising two ball bearings 94, two bearing retainers 98, an inner core 96, and an outer shell 100. The "v" notch or radial groove disposed into the roller may be dimensioned and arranged to provide guidance of each belt engagement which may be over 180° of arc, and to activate the separating load via rolling contact on center with the rotatable member of the follower.

In an embodiment, the rollers, and/or any surface of the device may comprise a wear resistant surface treatment 92 which may include a coating of titanium-nitride or the like for wear resistance. In an embodiment, the bearings 94 utilized in the design may be self-lubricated, steel, plastic, and/or ceramic ball type bearings and/or bushings which may be sealed to reduce likelihood of contamination. In an embodiment, the frictional member may comprise metal, and/or a polymeric resin, which may include glass or other fiber reinforced polyetheretherketone (peek), nylon, ABS, and/or the like. In an embodiment, the front axil, the rear axil, or both may an alloy steel, may be heat treated, or a combination thereof.

In an embodiment, the resilient member comprises a helical spring. The adjustment means may include a threated member and corresponding seat adapted to receive the threaded member such that rotation of the threaded member increases or decreases the amount of compression of the spring, thereby providing an adjustment of the frictional force provided by the exercise device in response to an applied force. In an embodiment, the adjustment means is accessible from the outer surface of the exercise device such that the frictional force may be adjusted by the end user. In an embodiment, the frictional member may be oriented to produce the bias force parallel to the front central axis such that the frictional force is applied to an end of the roller. In an embodiment, the resilient member may comprise a gas charged cylinder-piston arrangement capable of producing a consistent outward force. In an embodiment, the pressure in the gas charged cylinder-piston arrangement may be adjustable or variable to allow for adjustment of the frictional force. In an embodiment, the frictional force may be provide by a plurality of frictionally engaged dampers which rotate with a roller relative to a stationary platform which exerts a force on the dampers, with or without a resilient member, to provide the frictional force.

Accordingly, the present invention provides the following embodiments of the invention:

A. An Exercise Device Comprising:

a base frame comprising a plurality of belt members attached to, and arranged in parallel on the base frame, wherein each of the belt members comprises:

a front axle attached to the base frame oriented along a front central axis separated by a distance from a rear axle attached to the base frame having a rear central axis, wherein the front central axis is essentially parallel to the rear central axis;

a front roller disposed around the front axle and arranged to rotate around the front central axis;

a rear roller disposed around the rear axle and arranged to rotate around the rear central axis;

an endless belt having an infinite number of sides disposed around and in contact with a portion of the front roller and a portion of the rear roller, the endless belt having a major axis oriented perpendicular to the front central axis and a minor axis oriented parallel to the front central axis;

the exercise device further comprising at least one frictional member disposed in frictional contact with, and forcibly biased against a surface of at least one front roller, rear roller, or a combination thereof such that an external force directed perpendicular to the front central axis applied to at least one of the endless belts is opposed by a frictional force provided by the frictional contact between the frictional member and the at least one surface of the front roller, the rear roller, or a combination thereof.

B. The exercise device according to embodiment A, wherein the frictional member comprises a first end attached to the base frame, and a second end movably engaged with the first end, and a resilient member disposed between, and in mechanical contact with the first end and the second end, wherein the second end further comprises a follower arranged in frictional contact with the surface of the front roller, the rear roller, or a combination thereof, wherein the resilient member is dimensioned and arranged between the first end and the second end such that the follower is forcibly biased against the surface of the front roller, the rear roller, or a combination thereof, to provide the fictional force.

C. The exercise device according to embodiment A or B, wherein the resilient member comprises a compressible helical spring.

D. The exercise device according to embodiment A, B, or C, wherein the frictional member further comprises an adjustment means capable of providing a variable distance between the resilient member and the first end, the first end and the base frame, or a combination thereof such that the amount of bias force between the frictional member and the surface of at least one of the front roller, the rear roller, or a combination thereof is variable between an upper limit and a lower non-zero limit.

E. The exercise device according to embodiment A, B, C, or D, wherein the follower comprises a rotatable member disposed around and in rotational contact with a follower axel attached to the second end, wherein the follower axle is arranged such that the rotatable member has an axis of rotation parallel to the front central axis.

F. The exercise device according to embodiment A, B, C, D, or E, wherein the front axle, the rear axle, or both are movably attachable to the base frame, and are attachable to the base frame in an arrangement to provide a belt tension between the front axle and the rear axle through the endless belt, wherein the belt tension is independent of the frictional force provided by the frictional contact between the frictional member and the at least one surface of the front roller, the rear roller, or a combination thereof.

G. The exercise device according to embodiment A, B, C, D, E, or F, wherein the front roller, the rear roller, or both comprise a radial groove disposed into the surface of the roller which is dimensioned and arranged to receive a least a portion of the follower.

H. The exercise device according to embodiment A, B, C, D, E, F, or G, wherein the frictional member is forcibly biased against the surface of the front roller, the rear roller, or both in a direction perpendicular to the front central axis.

I. The exercise device according to embodiment A, B, C, D, E, F, G, or H having two belt members, wherein the front central axis and the rear central axis of each of the belt members are collinear.

J. The exercise device according to embodiment A, B, C, D, E, F, G, H, or I, comprising at least one frictional member which is frictionally engaged with two or more of the front rollers, two or more of the rear rollers, or any combination thereof.

K. The exercise device according to embodiment A, B, C, D, E, F, G, H, I, or J, wherein each of the endless belts are independently movable in a direction perpendicular to the front central axis in a direction from the rear central axis toward the front central axis, in a direction from the front central axis toward the rear central axis, or a combination thereof.

L. The exercise device according to embodiment A, B, C, D, E, F, G, H, I, J, or K, wherein the base frame is disposed within an outer covering, the outer covering comprising a plurality of openings through which at least a portion of each of the endless belts protrudes through.

M. The exercise device according to embodiment A, B, C, D, E, F, G, H, I, J, K, or L, wherein the base frame is supported on a horizontal surface by a plurality of supports connected to the base frame, and wherein the supports are dimensioned and arranged such that a line connecting the front central axis and the rear central axis is oriented at an angle of less than or equal to about 60° relative to the horizontal surface.

N. The exercise device according to embodiment A, B, C, D, E, F, G, H, I, J, K, L, or M, wherein at least one of the plurality of supports is independently adjustable such that the angle between the line connecting the front central axis and the rear central axis and the horizontal surface is adjustable between about 0° and about 60° relative to the horizontal surface.

O. The exercise device according to embodiment A, B, C, D, E, F, G, H, I, J, K, L, M, or N, wherein the frictional force opposed to the applied external force directed perpendicular to the front central axis applied to at least one of the endless belts is from about 1% to less than or equal to about 90% of the applied external force.

P. The exercise device according to embodiment A, B, C, D, E, F, G, H, I, J, K, L, M, N, or O, wherein the distance is greater than or equal to about 10 cm and less than or equal to about 50 cm, and wherein the minor axis of the endless belt is from about 5% to about 90% of the distance.

Q. The exercise device according to embodiment A, B, C, D, E, F, G, H, I, J, K, L, M, N, O, or P, wherein the endless belt comprises a plurality of ribs disposed on one or more sides of the endless belt.

R. The exercise device according to embodiment A, B, C, D, E, F, G, H, I, J, K, L, M, N, O, P, or Q, wherein the plurality of ribs are oriented perpendicular to the major axis of the endless belt.

S. A method to exercise comprising applying an external force to an endless belt of an exercise device in an amount sufficient to overcome a frictional force provided by the exercise device opposed to the applied force, wherein the exercise device comprises any one of the embodiments of A-R.

T. A method to exercise comprising applying an external force to an endless belt of an exercise device in an amount sufficient to overcome a frictional force provided by the exercise device opposed to the applied force, wherein the exercise device comprises a base frame comprising a plurality of belt members attached to, and arranged in parallel on the base frame, wherein each of the belt members comprises:

a front axle attached to the base frame oriented along a front central axis separated by a distance from a rear axle attached to the base frame having a rear central axis, wherein the front central axis is essentially parallel to the rear central axis;

a front roller disposed around the front axle and arranged to rotate around the front central axis;

a rear roller disposed around the rear axle and arranged to rotate around the rear central axis;

the endless belt having an infinite number of sides disposed around and in contact with a portion of the front roller and a portion of the rear roller, the endless belt having a major axis oriented perpendicular to the front central axis and a minor axis oriented parallel to the front central axis;

the exercise device further comprising at least one frictional member disposed in frictional contact with, and forcibly biased against a surface of at least one front roller, rear roller, or a combination thereof such that the external force directed perpendicular to the front central axis applied to at least one of the endless belts is opposed by the frictional force provided by the frictional contact between the frictional member and the at least one surface of the front roller, the rear roller, or a combination thereof.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

While the invention has been illustrated and described in detail in the drawings and foregoing description, the same is to be considered as illustrative and not restrictive in character, it being understood that only some embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

I claim:

1. An exercise device comprising:

a base frame comprising a plurality of belt members attached to, and arranged in parallel on the base frame, wherein each of the belt members comprises:

a front axle attached to the base frame oriented along a front central axis separated by a distance from a rear axle attached to the base frame having a rear central axis, wherein the front central axis is essentially parallel to the rear central axis;

a front roller disposed around the front axle and arranged to rotate around the front central axis;

a rear roller disposed around the rear axle and arranged to rotate around the rear central axis;

an endless belt having an infinite number of sides disposed around and in contact with a portion of the front roller and a portion of the rear roller, the endless belt having a major axis oriented perpendicular to the front central axis and a minor axis oriented parallel to the front central axis;

the exercise device further comprising at least one frictional member disposed in frictional contact with, and forcibly biased against a surface of at least one front roller, rear roller, or a combination thereof such that an external force directed perpendicular to the front central axis applied to at least one of the endless belts is opposed by a frictional force provided by the frictional contact between the frictional member and the at least one surface of the front roller, the rear roller, or a combination thereof; the frictional member comprises a first end attached to the base frame, and a second end movably engaged with the first end, and a resilient member disposed between, and in mechanical contact with the first end and the second end, wherein the second end further comprises a follower arranged in frictional contact with the surface of the front roller, the rear roller, or a combination thereof, wherein the resilient member is dimensioned and arranged between the first end and the second end such that the follower is forcibly biased against the surface of the front roller, the rear roller, or a combination thereof, to provide the fictional force.

2. The exercise device of claim 1, wherein the resilient member comprises a compressible helical spring.

3. The exercise device of claim 1, wherein the frictional member further comprises an adjustment means capable of providing a variable distance between the resilient member and the first end, the first end and the base frame, or a combination thereof such that the amount of bias force between the frictional member and the surface of at least one of the front roller, the rear roller, or a combination thereof is variable between an upper limit and a lower non-zero limit.

4. The exercise device of claim 1, wherein the follower comprises a rotatable member disposed around and in rotational contact with a follower axle attached to the second end, wherein the follower axle is arranged such that the rotatable member has an axis of rotation parallel to the front central axis.

5. The exercise device of claim 1, wherein the front axle, the rear axle, or both are movably attachable to the base frame, and are attachable to the base frame in an arrangement to provide a belt tension between the front axle and the rear axle through the endless belt, wherein the belt tension is independent of the frictional force provided by the frictional contact between the frictional member and the at least one surface of the front roller, the rear roller, or a combination thereof.

6. The exercise device of claim 1, wherein the front roller, the rear roller, or both comprise a radial groove disposed into the surface of the roller which is dimensioned and arranged to receive a least a portion of the follower.

7. The exercise device of claim 1, wherein the frictional member is forcibly biased against the surface of the front roller, the rear roller, or both in a direction perpendicular to the front central axis.

8. The exercise device of claim 1 having two belt members, wherein the front central axis and the rear central axis of each of the belt members are collinear.

9. The exercise device of claim 1, comprising at least one frictional member which is frictionally engaged with two or more of the front rollers, two or more of the rear rollers, or any combination thereof.

10. The exercise device of claim 1, wherein each of the endless belts are independently movable in a direction perpendicular to the front central axis in a direction from the rear central axis toward the front central axis, in a direction from the front central axis toward the rear central axis, or a combination thereof.

11. The exercise device of claim 1, wherein the base frame is disposed within an outer covering, the outer covering comprising a plurality of openings through which at least a portion of each of the endless belts protrudes through.

12. The exercise device of claim 1, wherein the base frame is supported on a horizontal surface by a plurality of supports connected to the base frame, and wherein the supports are dimensioned and arranged such that a line connecting the front central axis and the rear central axis is oriented at an angle of less than or equal to about 60° relative to the horizontal surface.

13. The exercise device of claim 10, wherein at least one of the plurality of supports is independently adjustable such that the angle between the line connecting the front central axis and the rear central axis and the horizontal surface is adjustable between about 0° and about 60° relative to the horizontal surface.

14. The exercise device of claim 1, wherein the frictional force opposed to the applied external force directed perpendicular to the front central axis applied to at least one of the endless belts is from about 1% to less than or equal to about 90% of the applied external force.

15. The exercise device of claim 1, wherein the distance is greater than or equal to about 10 cm and less than or equal to about 50 cm, and wherein the minor axis of the endless belt is from about 5% to about 90% of the distance.

16. The exercise device of claim 1, wherein the endless belt comprises a plurality of ribs disposed on one or more sides of the endless belt.

17. The exercise device of claim 16, wherein the plurality of ribs are oriented perpendicular to the major axis of the endless belt.

18. A method to exercise comprising applying an external force to an endless belt of an exercise device in an amount sufficient to overcome a frictional force provided by the exercise device opposed to the applied force, wherein the exercise device comprises a base frame comprising a plurality of belt members attached to, and arranged in parallel on the base frame, wherein each of the belt members comprises:

a front axle attached to the base frame oriented along a front central axis separated by a distance from a rear axle attached to the base frame having a rear central axis, wherein the front central axis is essentially parallel to the rear central axis;

a front roller disposed around the front axle and arranged to rotate around the front central axis;

a rear roller disposed around the rear axle and arranged to rotate around the rear central axis;

the endless belt having an infinite number of sides disposed around and in contact with a portion of the front roller and a portion of the rear roller, the endless belt having a major axis oriented perpendicular to the front central axis and a minor axis oriented parallel to the front central axis;

the exercise device further comprising at least one frictional member disposed in frictional contact with, and forcibly biased against a surface of at least one front roller, rear roller, or a combination thereof such that the external force directed perpendicular to the front central axis applied to at least one of the endless belts is opposed by the frictional force provided by the frictional contact between the frictional member and the at least one surface of the front roller, the rear roller, or a combination thereof; the frictional member comprises a first end attached to the base frame, and a second end movably engaged with the first end, and a resilient member disposed between, and in mechanical contact with the first end and the second end, wherein the second end further comprises a follower arranged in frictional contact with the surface of the front roller, the rear roller, or a combination thereof, wherein the resilient member is dimensioned and arranged between the first end and the second end such that the follower is forcibly biased against the surface of the front roller, the rear roller, or a combination thereof, to provide the fictional force.

* * * * *

UNITED STATES PATENT AND TRADEMARK OFFICE

CERTIFICATE OF CORRECTION

PATENT NO. : 8,986,176 B2
APPLICATION NO. : 13/406498
DATED : March 24, 2015
INVENTOR(S) : Lani Renae Arst It is certified that error appears in the above-identified patent and that said Letters Patent is hereby corrected as shown below:

In the Claims

Column 10, line 67, replace “fictional” with “frictional”
Column 12, line 60, replace “fictional” with “frictional”

Signed and Sealed this
Fifth Day of January, 2016

Michelle K. Lee

Michelle K. Lee
*Director of the United States Patent and Trademark Office*